US012466518B2

(12) United States Patent
Blanco

(10) Patent No.: US 12,466,518 B2
(45) Date of Patent: Nov. 11, 2025

(54) BOAT BAR ANCHOR

(71) Applicant: Vladimir Blanco, Valrico, FL (US)

(72) Inventor: Vladimir Blanco, Valrico, FL (US)

( * ) Notice: Subject to any disclaimer, the term of this patent is extended or adjusted under 35 U.S.C. 154(b) by 478 days.

(21) Appl. No.: 18/305,351

(22) Filed: Apr. 23, 2023

(65) Prior Publication Data

US 2024/0351665 A1 Oct. 24, 2024

(51) Int. Cl.
*B63B 21/26* (2006.01)
*B63B 21/20* (2006.01)

(52) U.S. Cl.
CPC ..... *B63B 21/26* (2013.01); *B63B 21/20* (2013.01)

(58) Field of Classification Search
CPC ..... B63B 21/20; B63B 21/24; B63B 21/243; B63B 21/26; B63B 21/29; B63B 21/262; B63B 21/30; B63B 21/34; B63B 21/36; B63B 21/38; B63B 21/40; B63B 21/42; B63B 21/44; B63B 21/46
See application file for complete search history.

(56) References Cited

U.S. PATENT DOCUMENTS

| | | | | | |
|---|---|---|---|---|---|
| 305,186 | A * | 9/1884 | Herman | B63B 21/26 | 114/301 |
| 3,516,379 | A * | 6/1970 | Skoog | B63B 21/26 | 114/294 |
| 4,577,581 | A * | 3/1986 | Puech | B63B 21/34 | 114/294 |
| 5,915,326 | A * | 6/1999 | Karal | B63B 21/27 | 114/294 |
| 8,869,728 | B1 * | 10/2014 | Paugh | B63B 21/243 | 114/303 |
| 2012/0000411 | A1 * | 1/2012 | Scoledes | B63B 21/243 | 114/297 |
| 2016/0059935 | A1 * | 3/2016 | Beatty | B63B 21/46 | 114/301 |

* cited by examiner

*Primary Examiner* — Andrew Polay
(74) *Attorney, Agent, or Firm* — Ruben Alcoba, Esq.

(57) ABSTRACT a boat bar anchor that is used to anchor on to a rocky seabed. The boat anchor comprises of a linear bar that has at least four y-wings that run along the length of the linear bar. A first end of the linear bar has a first anchor shackle receiver, and a second end of the linear bar has a second anchor shackle receiver, each shackle receiver receives an anchor shackle, the anchor shackles are configured to receive an anchor chain that is secured to a boat.

4 Claims, 7 Drawing Sheets

BOAT BAR ANCHOR

TECHNICAL FIELD

The present invention pertains to a boat bar anchor that is used to anchor a boat to a rocky seabed.

BACKGROUND

The inventor of the present invention is a boat captain who has vast experience in anchoring boats to rocky seabeds.

Anchors that are presently used to anchor boats to rocky seabeds tend to often get lost since they cannot be easily dislodged from the rocks in which they are anchored on.

The anchor of the present invention is designed to penetrate an aperture of a rocky seabed when a boat is moved in a first direction and to easily be withdrawn from the aperture when the boat is moved in an opposite direction.

The present invention is a boat anchor that is comprised of a linear bar that has at least four y-wings that run along the length of the linear bar.

The linear bar anchor's y-wings are designed to embed into apertures of the rocky seabed in a manner that will allow the boat anchor to be anchored on the rocky seabed, so long as a driving force is applied to the anchor. The y-wings are also designed to be easily withdrawn from the rocky seabed when a pulling force is applied to the anchor.

The present invention addresses the need of having a boat anchor that can easily be dislodged from a rocky seabed after the boat anchor is anchored on the rocky seabed.

SUMMARY

The present invention is directed to a boat bar anchor that is used to anchor to a rocky seabed.

The boat bar anchor comprises of a linear bar that has at least four y-wings that run along the length of the linear bar. A first end of the linear bar has a first anchor shackle receiver, and a second end of the linear bar has a second anchor shackle receiver, each shackle receiver receives an anchor shackle, the anchor shackles are configured to receive an anchor chain that is secured to a boat.

An object of the present invention is to provide a boat anchor that can be anchored into a rocky seabed.

Another object of the present invention is to provide a boat anchor that can easily be withdrawn from the rocky seabed once the boat anchor is anchored to the rocky seabed.

Yet another object of the present invention is to provide a boat anchor that will not be lost after being anchored to a rocky seabed.

BRIEF DESCRIPTION OF THE DRAWINGS

These and other features, aspects, and advantages of the present invention will become better understood with regards to the following description, appended claims, and drawings where:

DESCRIPTION

Figure 1:
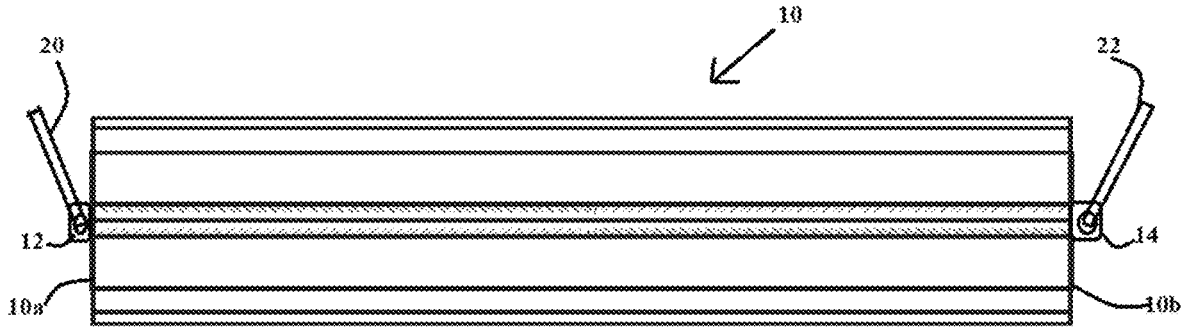
FIG. 1 is a side view of the present invention.
Figure 2:
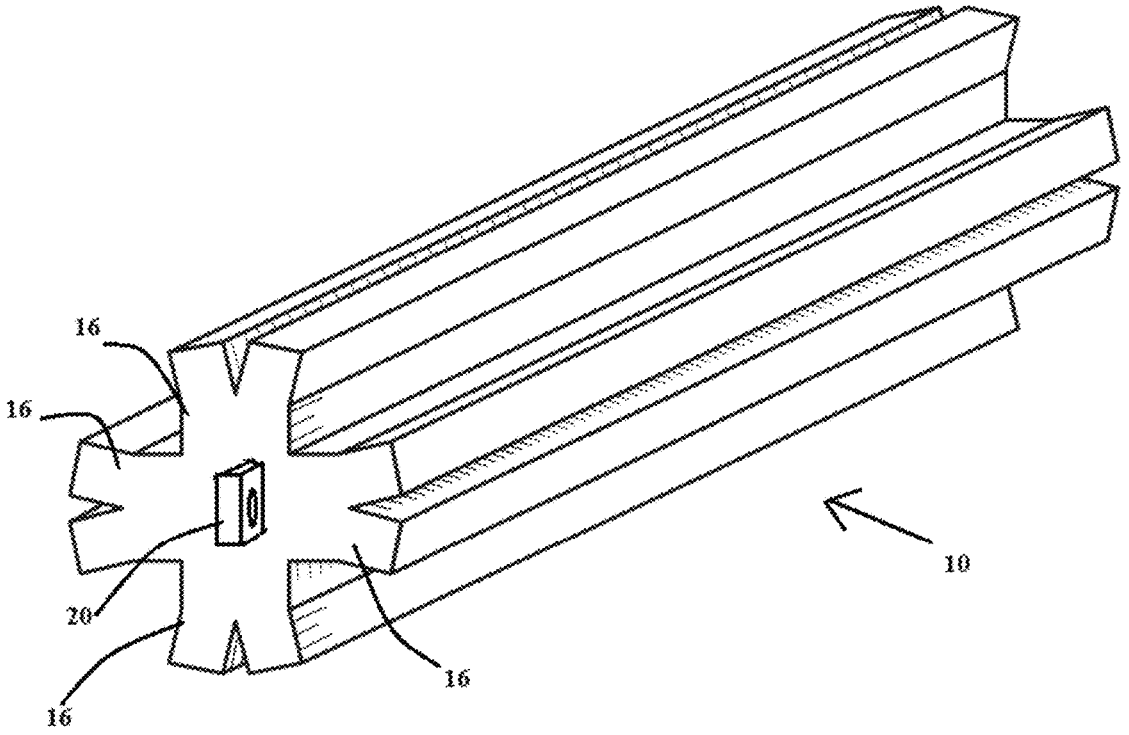
FIG. 2 is a perspective view of the linear boat anchor bar of the present invention.
Figure 3:
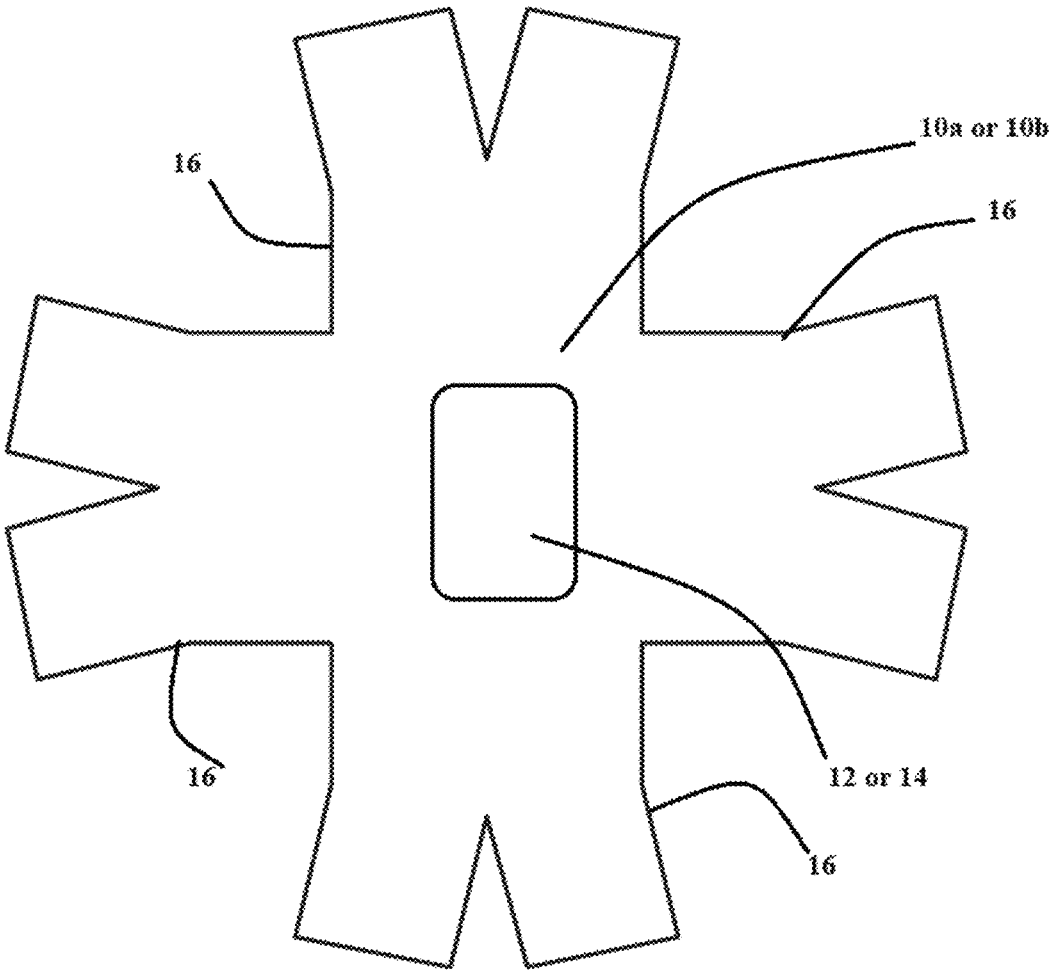
FIG. 3 is a front or rear view of the linear boat anchor bar of the present invention.
Figure 4:
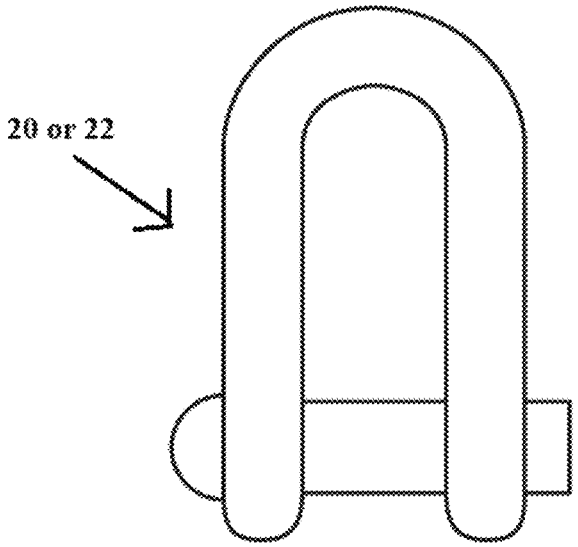
FIG. 4 is a front view of an anchor shackle that is secured to the present invention.
Figure 5:
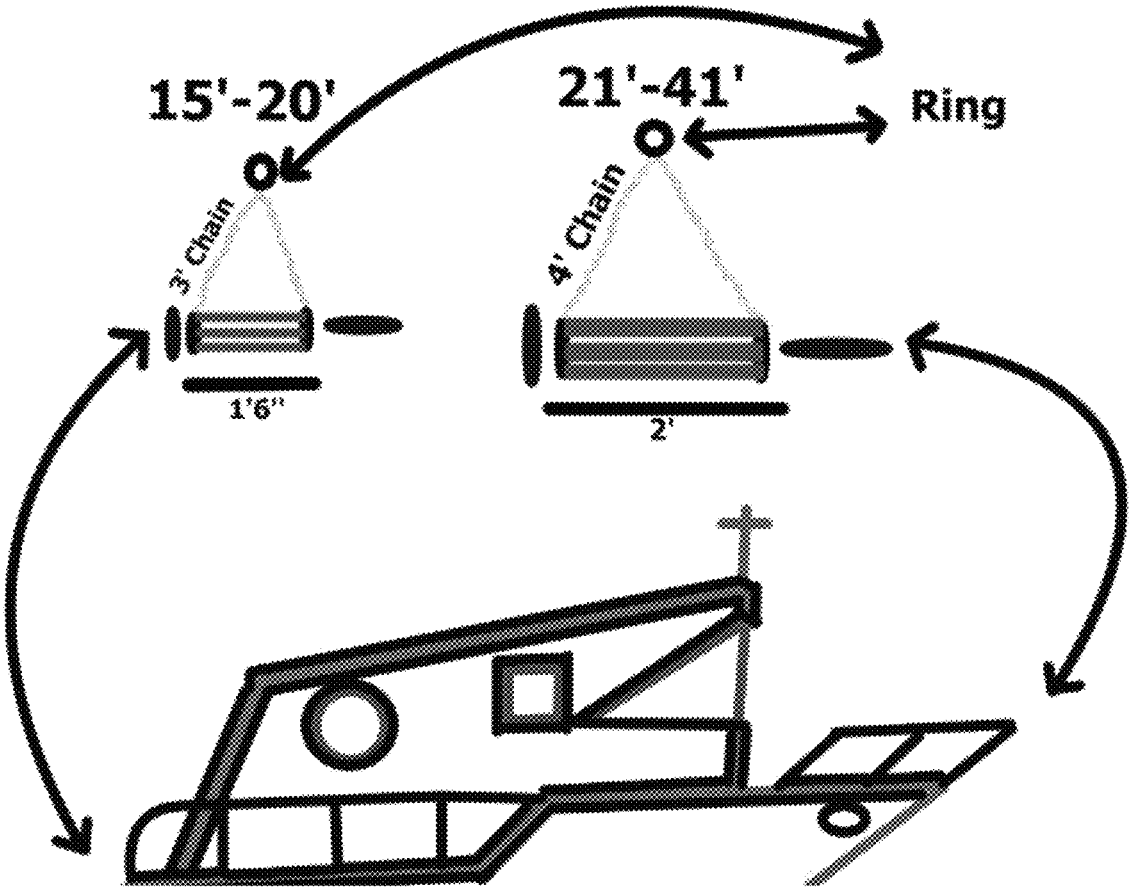
FIG. 5 is a visual representation that shows measurements of the linear bar and the measurements of the chains that are attached to the boat anchor of the present invention.
Figure 6:
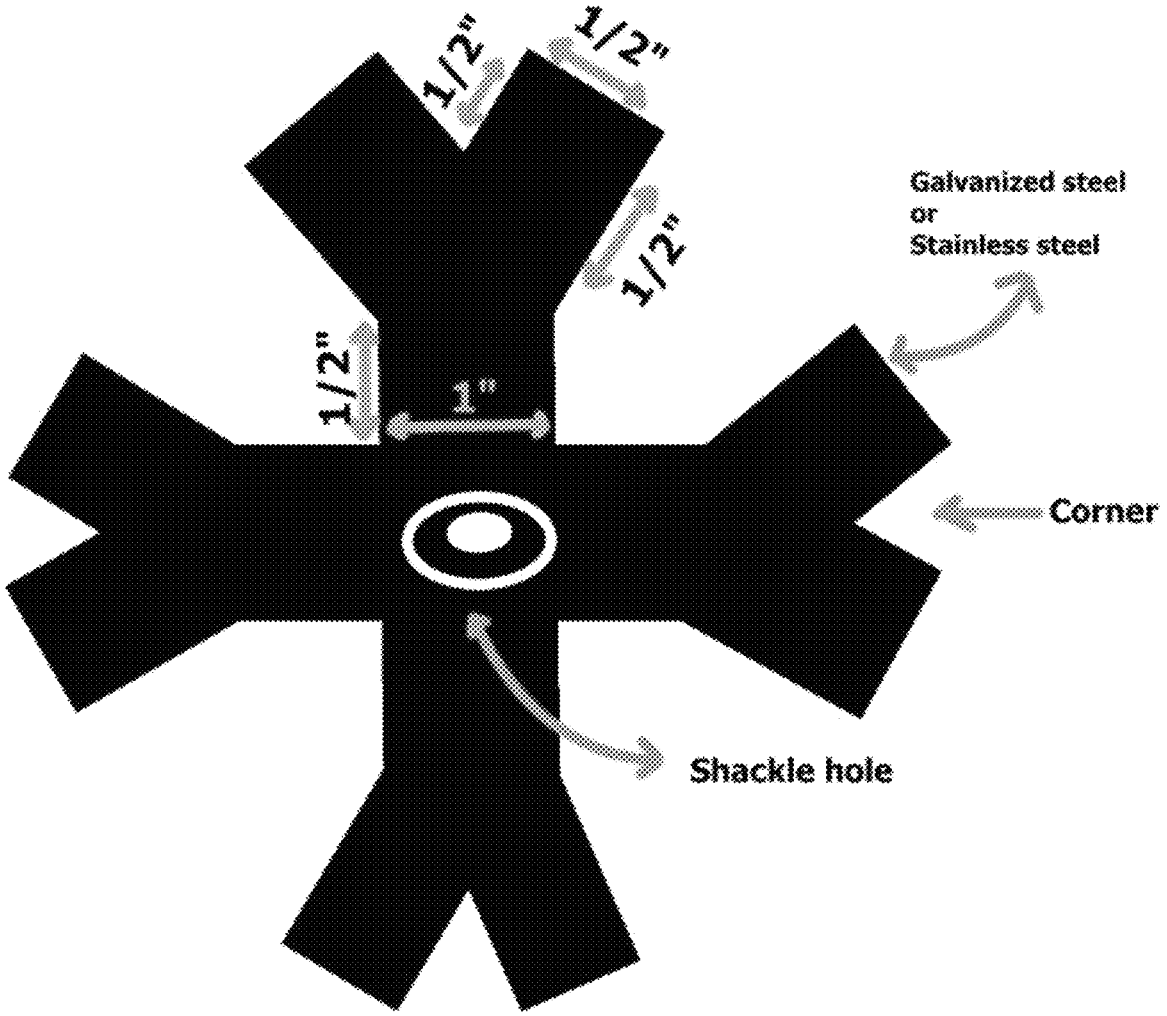
FIG. 6 is a visual representation that shows measurements of a preferred embodiment of the present invention.
Figure 7:
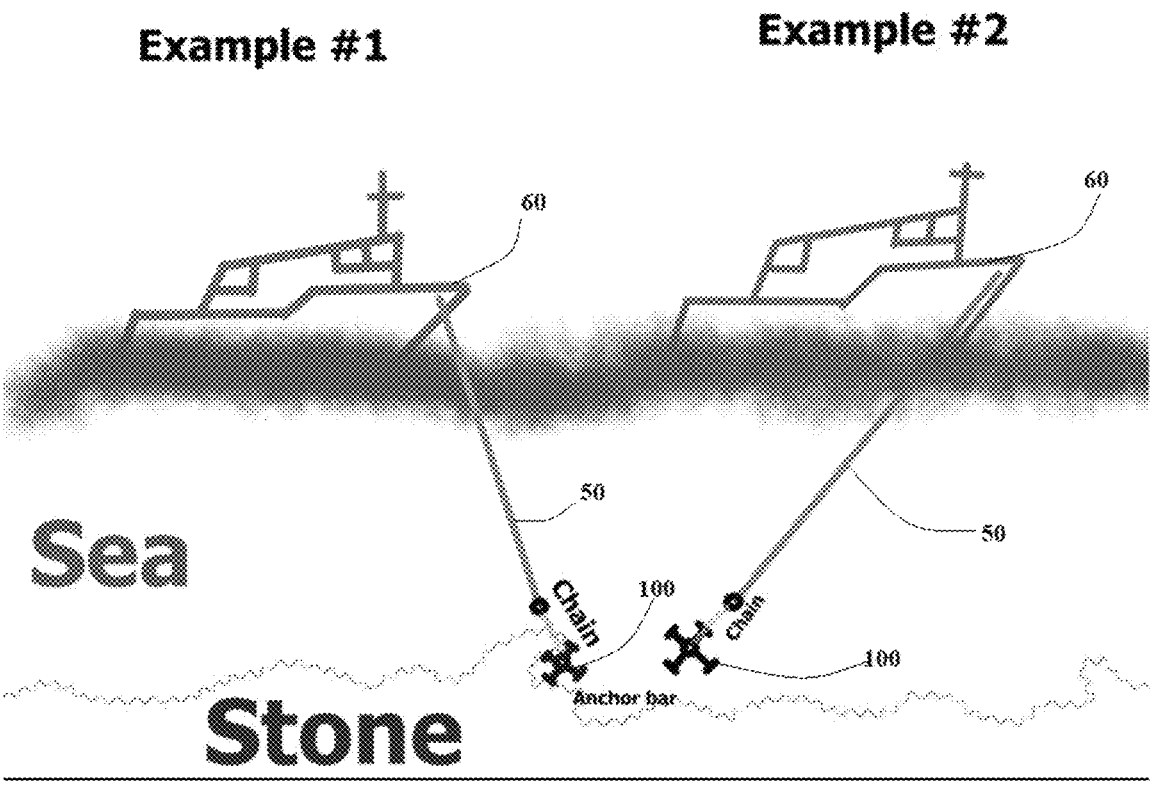
FIG. 7 is a visual representation that shows how the present invention is secured to a rocky seabed and how it is removed from the rocky seabed.
Figure 8:
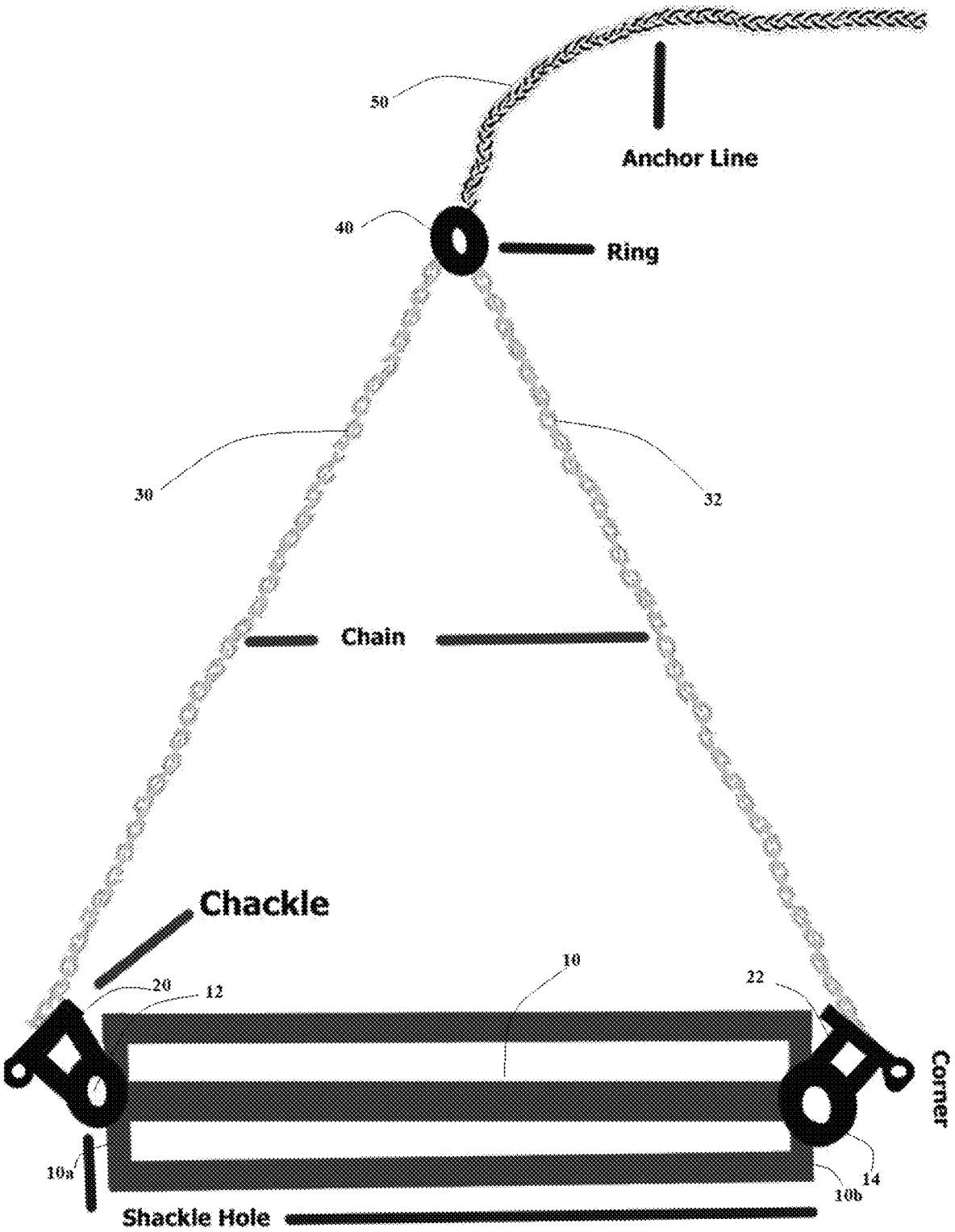
FIG. 8 is a side view that shows how the present invention is secured to an anchor chain that is attached to a boat.

As seen in FIGS. 1-8, the present invention is a linear boat anchor 100 that is used to anchor a boat to a rocky seabed The linear boat anchor 100 comprises of a linear bar 10 that has a front side 10*a* and a rear side 10*b*, the linear bar 10 defines a first receiver 12 on the front side 10*a* and a second receiver 14 on the rear side 10*b*, the linear bar 10 defines at least four y-wings 16 that run laterally along a length of the linear bar 10. A first shackle 20 is attached to the first receiver 12. A second shackle 22 is attached to the second receiver 14. A first chain 30 is attached to the first shackle 20, the first chain 30 is also attached to an anchor ring 40. And, a second chain 32 is attached the second shackle 22, the second chain is also attached to the anchor ring 40, the first chain 30 and the second chain 32 have a same length, the anchor ring 40 is configured to receive an anchor chain 50 that is secured to a boat 60.

In preferred embodiments of the present invention, the linear bar 10 is made of either of galvanized steel or stainless steel.

In an embodiment of the present invention, the linear bar 10 measures one foot and six inches, and the first chain 30 and the second chain 32 measure three feet.

In another embodiment of the present invention, the linear bar 10 measures two feet, and the first chain 30 and the second chain 32 measure four feet.

The embodiments of the linear boat anchor described herein are exemplary and numerous modifications, combinations, variations, and rearrangements can be readily envisioned to achieve an equivalent result, all of which are intended to be embraced within the scope of the appended claims. Further, nothing in the above-provided discussions of the linear boat anchor should be construed as limiting the invention to an embodiment or a combination of embodiments. The scope of the invention is defined by the description, drawings, and claims.

What is claimed is:

1. A linear boat anchor that is used to anchor a boat to a rocky seabed, the linear boat anchor comprises:

a linear bar that has a front side and a rear side, the linear bar defines a first receiver on the front side and a second receiver on the rear side, the linear bar defines at least four y-wings that run laterally along a length of the linear bar;

a first shackle is attached to the first receiver;

a second shackle is attached to the second receiver;

a first chain is attached to the first shackle, the first chain is also attached to an anchor ring; and a second chain is attached the second shackle, the second chain is also attached to the anchor ring, the first chain and the second chain have a same length, the anchor ring is configured to receive an anchor chain that is secured to a boat.

2. The linear boat anchor that is used to anchor the boat to the rocky seabed of claim 1, wherein the linear bar is made of either galvanized steel or stainless steel.

3. The linear boat anchor that is used to anchor the boat to the rocky seabed of claim 2, wherein the linear bar measures one foot and six inches, and the first chain and the second chain measure three feet.

4. The linear boat anchor that is used to anchor the boat to the rocky seabed of claim 2, wherein the linear bar measures two feet, and the first chain and the second chain measure four feet.

* * * * *